United States Patent [19]

Searcy

[11] Patent Number: 4,615,335

[45] Date of Patent: Oct. 7, 1986

[54] MOTORIZED EXERCISE APPARATUS FOR MOUNTING ON HOSPITAL BEDRAIL

[76] Inventor: Charles C. Searcy, P.O. Box 23, Wauchula, Fla. 33873

[21] Appl. No.: 672,136

[22] Filed: Nov. 16, 1984

[51] Int. Cl.[4] ..... A61H 1/02

[52] U.S. Cl. ..... 128/25 R; 128/25 B; 272/900; 272/143

[58] Field of Search ..... 272/73, 900, 143; 128/25 R, 25 B; 248/225.31, 205.1, 214, 231.4; 5/443, 444, 63, 66

[56] References Cited

U.S. PATENT DOCUMENTS

| | | | |
|---|---|---|---|
| 1,568,930 | 1/1926 | Symmes et al. | 248/225.31 |
| 1,686,551 | 10/1928 | Carmichael | 248/225.31 |
| 2,777,439 | 1/1957 | Tuttle | 128/25 R |
| 2,841,139 | 7/1958 | Tarr | 128/25 R |
| 3,455,295 | 7/1969 | Kellogg | 128/25 R |
| 3,516,661 | 6/1970 | Hansen | 272/80 |
| 4,126,290 | 11/1978 | Drouillard | 248/226.1 |
| 4,169,591 | 10/1979 | Douglas | 272/144 |

FOREIGN PATENT DOCUMENTS

| | | | |
|---|---|---|---|
| 434942 | 12/1974 | U.S.S.R. | 128/25 R |

*Primary Examiner*—Richard J. Apley
*Assistant Examiner*—John L. Welsh
*Attorney, Agent, or Firm*—Duckworth, Allen, Dyer

[57] ABSTRACT

Apparatus for permitting exercise by a bedridden patient includes a patient bed having guard rails extending generally along one side and with a bracket supported by the rails. A motor is carried by the bracket, the motor having a drive shaft extending generally normal to the rails and toward the bed. A crank arm is fixed at one end to the drive shaft and dimensioned substantially shorter than the distance between the drive shaft and the surface of the bed, with a handle or footstrap at the other end of the crank arm for permitting a hand or foot of the patient to be coupled to the crank arm so that the patient may exercise by rotation of the crank arm and the drive shaft.

12 Claims, 3 Drawing Figures

MOTORIZED EXERCISE APPARATUS FOR MOUNTING ON HOSPITAL BEDRAIL

BACKGROUND OF THE INVENTION

1. Field of the Invention

The present invention relates generally to exercise machines, and is specifically directed to a motorized exercise machine adapted for portable mounting on hospital bedrails and adjustable with respect to the patient to permit a bedridden patient to exercise either the hand, arm and shoulder, or alternatively, foot, ankle, leg and knee.

2. Description of the Prior Art

There is a wide variety of prior art of exercise and therapy machines, both motor driven and otherwise, for exercising or conducting specific therapy movements of one or another set of muscles of the body of the user or patient.

Examples of a muscle-specific exercise machine are contained in the following United States patents, all of which are directed to therapy or exercise of leg, ankle and foot muscles: U.S. Pat. No. 206,902 to Kost; U.S. Pat. No. 1,948,534 to Nelson, et al.; U.S. Pat. No. 3,917,261 to Small, et al.; and U.S. Pat. No. 3,526,220.

In U.S. Pat. No. 4,355,633, Heilbrun discloses an adjustable, multi-function motorized exercise apparatus. In. U.S. Pat. No. 4,222,376, Praprotnik discloses an exercise machine for restoring lost movement caused by arthritis in the shoulders, elbows and wrists.

SUMMARY OF THE INVENTION

The present invention contemplates a portable patient exercising apparatus or machine adapted for interconnection to guard rails extending generally horizontally along one side of a patient bed. The portable apparatus comprises bracket means adapted to be supported by the rails, with a motor carried by the bracket means, the motor having a drive shaft extending generally normal to the bracket so as to be substantially normal to the rail and toward the bed when properly affixed to the rails. A crank arm is fixed at one end to the drive shaft, the crank arm dimensioned substantially shorter than the distance between the drive shaft and the surface of the bed, with means at the other end of the crank arm for permitting a foot or hand of the patient to be coupled thereto for permitting exercise of the patient by rotation of the crank arm and drive shaft. This portable apparatus in accordance with the present invention is particularly suitable for bedridden stroke patients who are unable to stand or sit, but who would benefit from simple rotational movements of the arm or leg while bedridden.

In accordance with the preferred embodiment of the present invention, the bracket includes means for releaseably coupling the motor with the guard rail, and for permitting the bracket-motor combination to slide along the guard rails for adjustment. Locking means are provided for fixing the location of the motor-bracket combination at a desired location along the rails.

In the preferred embodiment, the bracket means includes a motor mount and two clamps. One of the clamps is fixed to the motor mount and adapted to engage one of the rails, the other clamp adapted to engage a second rail with means for releaseably urging the other clamp toward the first clamp, the other clamp being engageable with a second rail spaced from and generally parallel with the one rail associated with the first clamp. Suitably, the releaseably urging means comprises a load spring extending generally along a vertical tube fixed at one end to the motor mount and carrying the first clamp in a fixed relationship, and the second clamp in a sliding relationship.

Further, in accordance with the preferred embodiment of the present invention, the motor mounted on the bracket preferably comprises an electric motor; however, other forms of motors, such as a resistance or friction motor, may likewise be suitable for stronger patients. Preferably, a control cord is electrically coupled with the motor and is of sufficient length to extend across at least a portion of the surface of the bed, with switch means at the extremity of the control cord for permitting the patient to control the operation of the motor.

As noted above, the extremity of the crank arm may be fitted with means for permitting the patient to engage the crank arm with the hand or foot. In the case of the hand, a simple handle is sufficient; in the case of the foot, a boot and strap combination is provided to prevent injury.

DETAILED DESCRIPTION OF THE PREFERRED EMBODIMENT

Portable exercise apparatus for use with a conventional hospital bed and bedrail combination will now be described with reference to the drawings.

Figure 1:
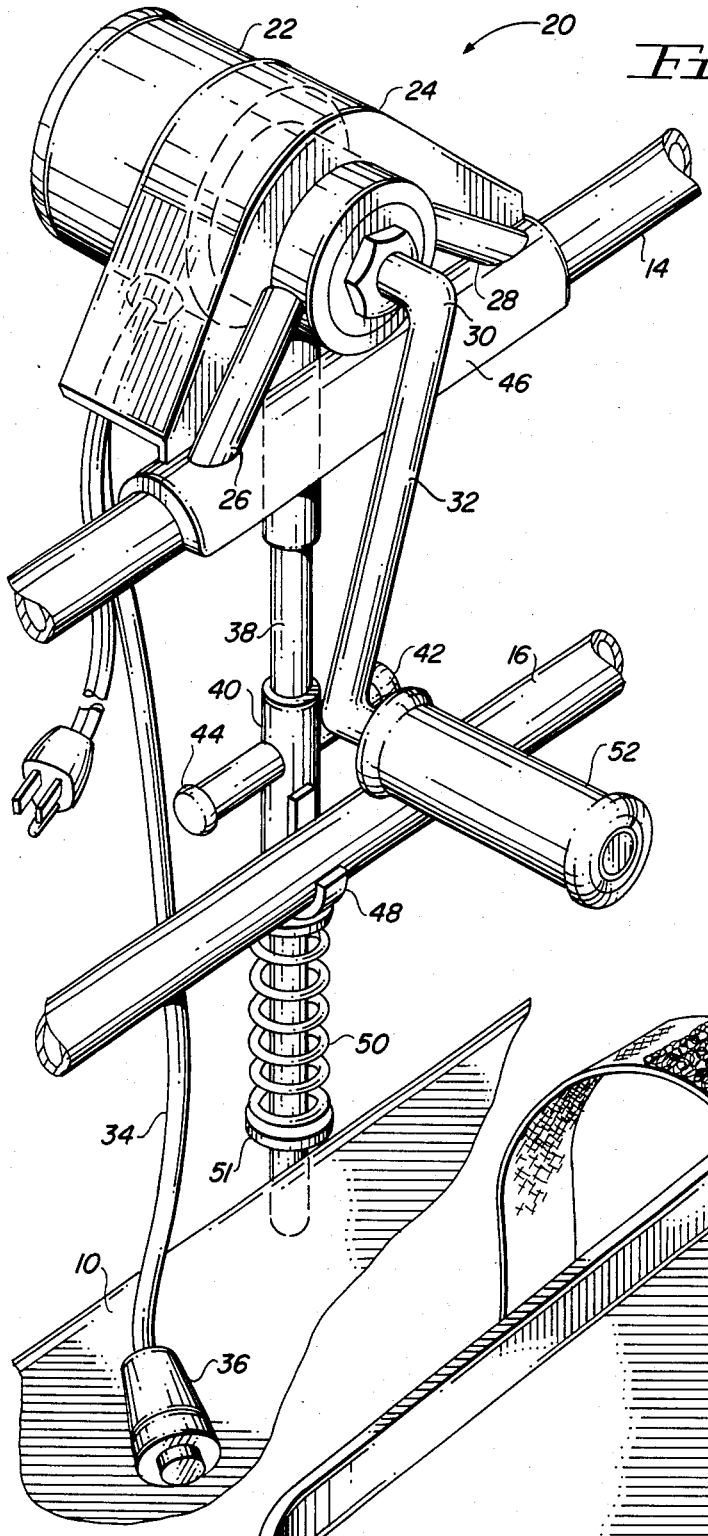
FIG. 1 is a perspective view illustrating the portable exercising apparatus of the present invention, in combination with a hospital bed and guard rail combination.

Noting FIG. 1, a hospital bed 10 is fitted with a guard rail fixture 12, the guard rail fixture including first and second generally parallel rails 14 and 16. The size and dimensions of the bed 10 and rail fixture 12 is not critical, as the portable exercise apparatus of the present invention is adapted to fit hospital bed-guard rail fixture combinations having a wide range of dimensions and configurations.

As is shown in FIG. 1, the present invention includes a portable exercise apparatus, referred to generally by the reference numeral 20. The exerciser includes an electric motor 22 fixed to a motor mount 24, with the motor mount in turn joined to a bracket including a pair of struts 26, 28. The motor 22 includes a drive shaft 30 to which is fixed a crank arm 32.

The motor 22 is further provided with an electric control cord 34 of sufficient length th extend across the surface of the bed 10, having a switch 36 at the extremity of the control cord 34 to permit the patient to control the turning off and on of the electric motor 22.

The portable electric apparatus 20 is further provided with a vertical tube 38 affixed to the motor mount-bracket combination 24, 26 and 28. A second tube 40 having an outer diameter greater than the outer diameter of the tube 38 slides along the tube 38, and includes a pair of carrying handles 42, 44 attached thereto. A first clamp 46 is fixed to the struts 28 and to the vertical tube 38, the first clamp 46 being adapted to engage the first rail 14 of the guard rail fixture 12.

A second clamp 48 is fixed to the second tube 40. A load spring 50 is fitted axially about the first tube 38 with the upper extremity of the load spring 50 engaging the second clamp 48 and lower extremity thereof being fixed by a fastener 51 extending through tube 38. As can be seen, the compression of the load spring 50 forces the second clamp 48 into engagement with another of the parallel guard rails, for example guard rail 16, to hold the portable exercise apparatus 20 firmly in place along the guard rail fixture 12.

Figure 3:
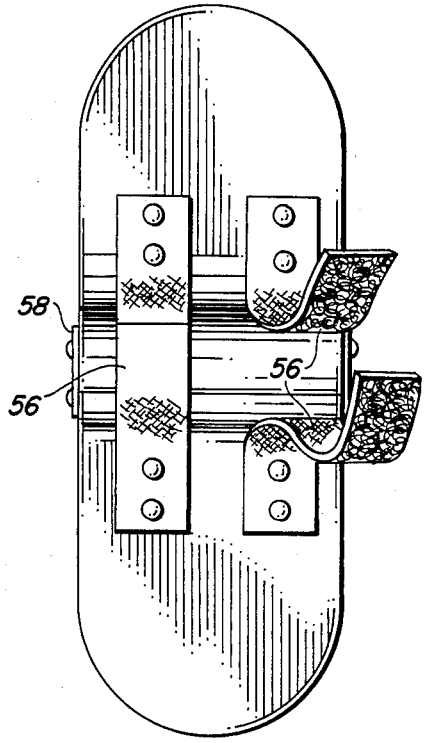
FIGS. 2 and 3 illustrate a boot and strap mechanism for use with a patient's foot as an alternate embodiment of the present invention.
Figure 2:
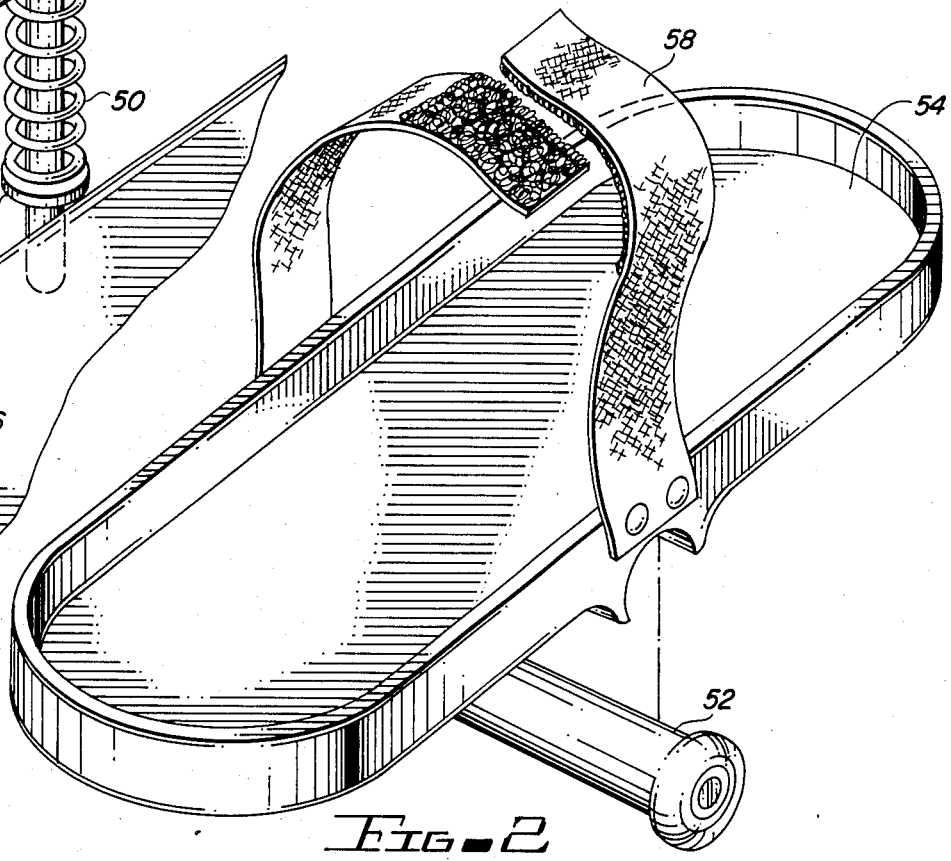

A simple handle 52 may be attached to the outer extremity of the crank arm 32 for engagement with the patient's hand; or in the alternative, when it is desirable to exercise the patient's leg muscles, a foot strap and boot arrangement such as is shown in FIGS. 2 and 3 may be substituted for the handle 52. In FIGS. 2 and 3, the alternative mechanism inlcudes a molded, open boot 54 having clamps 56 for fastening to the handle 52, and a removable strap 58 for holding the patient's foot in the boot 54.

It will be appreciated by those skilled in the art that the portable exercise apparatus of the present invention may be easily adapted to a variety of hospital bed-guard rail fixture combinations with the exerciser being adapted to be positioned anywhere along the guard rails as is desired for exercising either the patient's arms or legs. Further, the patient may easily control the operation of the exerciser via the control cord and switch combination. As was discussed above, the portable exercise apparatus of the present invention is particularly suitable for use with stroke patients who are bedridden.

I claim:

1. Apparatus for permitting exercise by a bedridden patient, said apparatus comprising:

(a) a patient bed having guard rails extending generally along one side;

(b) bracket means supported by said rails for attaching said apparatus to said guard rails, said bracket means including (1) a motor mount;

(2) a first clamp fixed with said motor mount and adapted to engage one of said rails;

(3) a second clamp adapted to engage a second one of said guard rails;

(4) a tube extending generally normal to the longitudinal direction of said rails, said tube carrying said second clamp and a load spring axially about said tube and said spring urging said second clamp toward said first clamp;

(c) a motor carried by said bracket means, said motor having a drive shaft extending generally normal to said rails and toward said bed;

(d) a crank arm fixed at one end to said drive shaft, said crank arm dimensioned substantially shorter than the distance between said drive shaft and the surface of said bed; and (e) means at the other end of said crank arm for permitting a foot or hand of the patient to be coupled thereto for exercise of the patent by rotation of the crank arm and said drive shaft.

2. The exercise apparatus recited in claim 1 wherein said bracket means includes means for sliding said motor longitudinally along said rails.

3. The exercise apparatus recited in claim 1 wherein said bracket means includes means releaseably coupling said motor with said guard rails.

4. The exercise apparatus recited in claim 1 wherein said bracket means further comprises means for locking said motor in a fixed location along said rails.

5. The exercise apparatus recited in claim 1 wherein said motor comprises an electric motor.

6. The exercise apparatus recited in claim 5 further comprising:

(a) a control cord electrically coupled with said electric motor, said cord being of sufficient length to extend at least partially across said bed when said motor is mounted on said rails; and (b) switch means at the extremity of said control cord for permitting said patient to control operation of said electric motor.

7. The exercise apparatus recited in claim 1 wherein said means at the other end of said crank arm further comprising means for strapping the patient's foot thereto.

8. The exercise apparatus recited in claim 7 wherein said strapping means comprises:

(a) an open boot for receiving the patient's foot;

(b) clamp means for fixing said boot to said crank arm; and (c) a flexible strap attached to said foot for holding the patient's foot in said boot.

9. Portable patent exercising apparatus adapted for interconnection to guard rails extending generally horizontally along one side of a patient bed, said portable apparatus comprising:

(a) bracket means, said bracket means including (1) a motor mount;

(2) a first clamp fixed with said motor mount and adapted to engage one of said rails;

(3) a second clamp adapted to engage a second one of said guard rails; and (4) a tube extending generally normal to the longitudinal direction of the rails of said bed, said tube carrying said second clamp and a load spring axially about said tube and said load spring for urging said second clamp toward said first clamp;

(b) a motor carried by said bracket means, said motor having a drive shaft adapted to extend generally normal to said rails and toward said bed when said bracket is mounted to said horizontal bed rails;

(c) a crank arm fixed at one end to said drive shaft, said crank arm dimensioned substantially shorter than the distance between said drive shaft and the surface of a hospital bed to which said apparatus is adapted for use; and (d) means at the other end of said crank arm for permitting the foot or hand of the patient to be coupled thereto for permitting exercise of the patient by rotaton of the crank arm and the drive shaft.

10. The portable patient exercising apparatus recited in claim 9 wherein said motor comprises an electric motor.

11. The portable patient exercising apparatus recited in claim 10 further comprising:

(a) a control cord electrically coupled with said electric motor, said cord being of sufficient length to extend at least partially across said bed when said motor is mounted on said rail; and (b) switch means at the extremity of said control cord for permitting said patient to control operation of said electric motor.

12. In combination:

(a) a hospital bed having a pair of spaced-apart tubular rails extending above and along one side of said bed;

(b) a bracket adapted for sliding along said bedrails, said bracket including a first clamp fitting about a first, upper one of said bedrails above said bed, a second clamp fitting about a second, lower one of said bedrails, a first vertical tube extending normal to the longitudinal direction of said bedrails and coupled with said first clamp, a second vertical tube about said first tube and coupled with said second clamp, with a load spring axially about said first tube urging said second tube toward said first clamp;

(c) an electric motor carried by said first clamp of said bracket, said motor having a drive shaft extending generally parallel to the upper surface of said bed and across the plane defined by said first and second bedrails;

(d) a crank arm fixed at one end of said drive shaft, said crank arm dimensioned substantially shorter than the distance between said drive shaft and the surface of said bed; and (e) means at the other end of said crank arm for permitting a hand or foot of a patient to be coupled thereto for exercise of the patient by rotation of the crank arm and said drive shaft.

* * * * *